United States Patent [19]

Tanaka et al.

[11] 4,326,281

[45] Apr. 20, 1982

[54] MOUNTING STRUCTURE OF PLASTIC GLASS IN WATCH CASE

[75] Inventors: Ryuzo Tanaka, Tanashi; Hisao Ishigaki, Tokyo, both of Japan

[73] Assignee: Citizen Watch Co., Ltd., Tokyo, Japan

[21] Appl. No.: 162,885

[22] Filed: Jun. 25, 1980

Related U.S. Application Data

[63] Continuation of Ser. No. 951,016, Oct. 12, 1978, abandoned.

[30] Foreign Application Priority Data

Oct. 13, 1977 [JP] Japan ..... 52-137120[U]
Dec. 15, 1977 [JP] Japan ..... 52-168668[U]

[51] Int. Cl.[3] ..... G04B 37/00
[52] U.S. Cl. ..... 368/294
[58] Field of Search ..... 368/276, 291, 292, 294–296, 368/309

[56] References Cited

U.S. PATENT DOCUMENTS 2,621,468 12/1952 Colomb ..... 360/294
2,792,684 5/1957 Dinstman ..... 368/294

FOREIGN PATENT DOCUMENTS 846977 7/1949 Fed. Rep. of Germany ..... 368/294
313607 10/1952 Switzerland ..... 368/294

*Primary Examiner*—Vit W. Miska
*Attorney, Agent, or Firm*—Birch, Stewart, Kolasch & Birch

[57] ABSTRACT

A mounting structure of plastic glass in the watch case enabling the mounting with a minimum amount of necessary deflection of the glass for preventing the crack of the glass. The glass has a radially extending projection in the lower portion of the periphery thereof and the watch case has a recess which has a radially extending groove which is adapted to engage the projection of the glass. The recess is provided with a beveled guiding portion at the entrance edge thereof and the projection has a beveled guiding portion at the leading edge thereof. The glass may be inserted into the recess of the case with the projection sliding on the beveled guiding edge of the recess.

8 Claims, 10 Drawing Figures

PRIOR ART Fig. 1
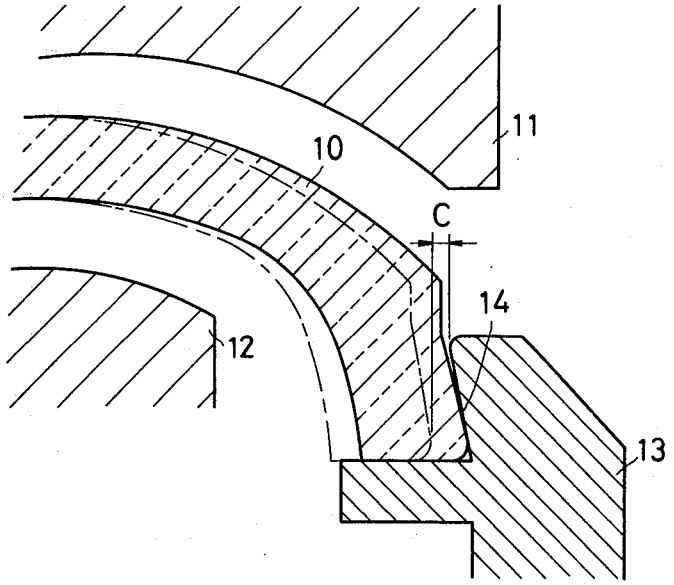
Fig. 2
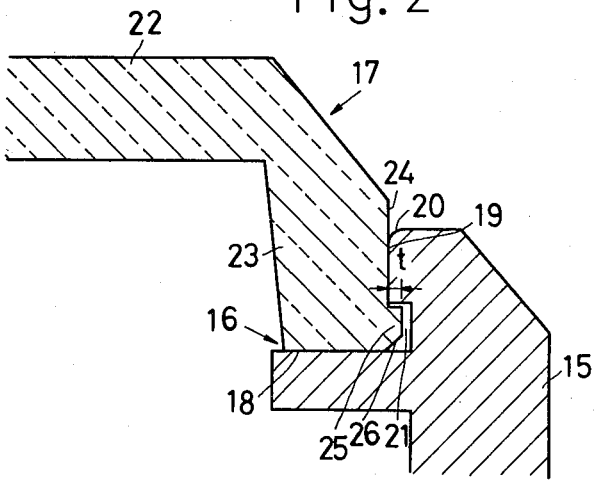

MOUNTING STRUCTURE OF PLASTIC GLASS IN WATCH CASE

This application is a continuation of copending application Ser. No. 951,016, filed on Oct. 12, 1978, now abandoned.

BACKGROUND OF THE INVENTION

The present invention relates to a mounting structure of plastic glass in a watch case.

In order to mount a plastic glass cover in a watch case, the plastic glass is deflected by a tool with the aid of jigs to a diameter smaller than the opening for the glass of the watch case. After the plastic glass is inserted into the opening of the watch case, the jigs are removed to permit the case to engage with the plastic glass in the recess of the watch case. Since the plastic glass is considerably deflected to contract its diameter, stress is produced in the glass during the mounting operation. The stress will eventually cause a crack to develop in the glass after a long period of use, which results in penetration of water and dust into the watch in addition shortens the life of the glass. If the glass is excessively deflected, a permanent set will remain in the glass resulting in a permanent deflection. Such deflection will decrease the resistivity to the penetration of water and dust and cause removal loss of the glass in an extreme case.

On the other hand, the plastic glass must be made in a spherical shape to allow for a certain amount of deflection. Therefore, it is impossible to design the plastic glass into another shape such as crystalline shape.

SUMMARY OF THE INVENTION

It is an object of the present invention to provide a mounting structure for plastic glass in a watch case which has high water and dust resistivity and durability.

Another object of the present invention is to provide a plastic glass mounting structure in which the plastic glass may be easily fitted to the watch case.

A further object of the present invention is to provide a plastic glass mounting structure which makes it possible to design the glass in various shapes.

According to the present invention, there is provided a mounting structure for plastic glass in the watch case comprising a recess provided on the upper portion of said watch case, said recess comprising an axially extending glass fitting portion and a radially extending glass receiving portion, an engaging groove provided adjacent the extreme end of said glass fitting portion, and a beveled guiding portion provided in the entrance edge of said axially extending glass fitting portion, said plastic glass comprising a central portion, an axially extending portion, a fitting portion provided on the outer periphery of said axially extending portion, a radially extending projection adapted to be engaged with said engaging groove, and a beveled guiding portion provided in the leading edge of said projection, said plastic glass being adapted to be inserted into said recess with said radially extending projection sliding on the axially extending portion of the recess so that said radially extending projection may be engaged with said groove.

These and further objects and advantages of the invention will be more apparent upon reference to the following description with reference to the accompanying drawings.

BRIEF DESCRIPTION OF THE DRAWINGS

FIG. 1 is a sectional view showing a conventional plastic glass mounting,

FIG. 2 is a sectional view showing a plastic glass mounting according to an embodiment of the present invention.

DESCRIPTION OF THE PREFERRED EMBODIMENTS

Figure 3:
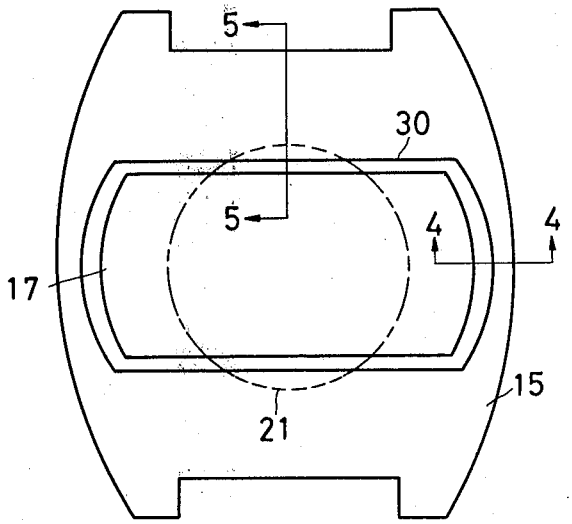
FIG. 3 is a plan view showing a watch case of the another embodiment of the present invention.

Referring to FIG. 1 showing a conventional plastic glass mounting, a plastic glass 10 has a spherical central portion and a beveled peripheral portion. The plastic glass is deflected by a tool (not shown) with the aid of jigs 11 and 12 to the contracted position shown by the dotted line in FIG. 1. Under the contracted condition, the plastic glass is inserted in the opening of the watch case 13. Thereafter the jigs 11 and 12 are removed, whereby the beveled periphery of the glass engages the recess 14 of the watch case. In this operation, the plastic glass is considerably deflected, which results in the generation of considerable stress in the glass. It is said that the distance "C" between the contracted periphery and the edge of the recess 14 is about 0.5 mm. As previously stated, the stress will bring about cracks in the glass, which will deteriorate the watertight and dust proof seal. The present invention eliminates such disadvantages.

Referring to FIG. 2, a watch case 15 has a recess 16 for receiving a plastic glass 17. The recess 16 comprises a radially extending glass receiving portion 18, an axially extending glass fitting portion 19, a beveled guiding portion 20 provided in the entrance edge of the recess 16, and an annular engaging groove 21 provided adjacent the extreme end portion of the glass fitting portion 19. It will be understood that the engaging groove 21 may be partially provided in the glass fitting portion 19.

The plastic glass 17 has a central plane portion 22, an axially extending cylindrical portion 23, a fitting portion 24 to be engaged with the fitting portion 19 of the case, an annular projection 25 provided adjacent the extreme end portion of the fitting portion 24, and a beveled guiding portion 26 provided in the leading edge of the projection 25.

In order to fit the plastic glass to the case, the glass 17 is put on the case, where the beveled guiding portion 26 of the glass engages with the guiding portion 20 of the case. Pushing the glass to the case, the guiding portion 26 slides on the guiding portion 20 and glass fitting portion 19 and reaches the extreme end, where the projection 25 snugly engages with the groove 21 and the fitting portion 24 is pressed against the fitting portion 19 of the case.

Since the glass is inserted into the recess 16 with its projection 25 sliding on the glass fitting portion 19, the glass can be easily mounted in the case with a minimum deflection amount of. More particularly, in the present invention, the glass may be exposed a small deflection "t" as shown in FIG. 2, thereby eliminating the deflection "c" as shown in FIG. 1. It will be seen that the deflection of the glass in the present invention is smaller than that of the conventional glass, and hence the stress produced in the plastic glass according to the present invention is lower than that produced in the conventional glass. According to experiments conducted by inventors, it has been found that the deflection "t" of about 0.1 mm is sufficient to maintain the glass in the recess.

Figure 4:
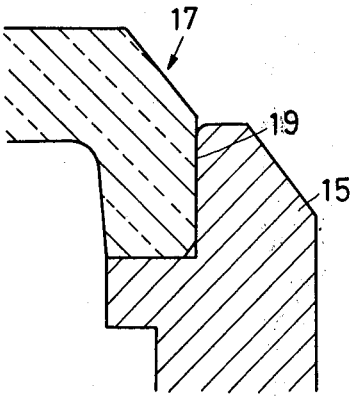
FIG. 4 is a sectional view taken along the line 4—4 in FIG. 3.
Figure 5:
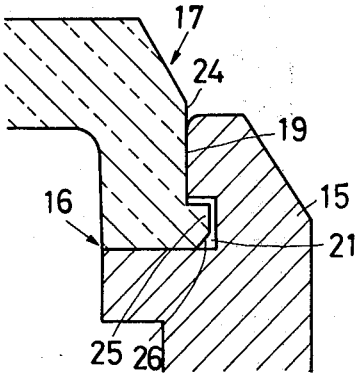
FIG. 5 is a sectional view taken along the line 5—5 in FIG. 3.

In the embodiment shown in FIGS. 3 to 5, the present invention is applied to a barrel-shaped plastic glass. There is provided a pair of engaging grooves 21 along opposite lateral edges 30 of the recess 16 of the case 15. Each engaging groove 21 has a semicircular shape in the plan view as shown in FIG. 3 by the dotted line, which results from the turning cutting. The plastic glass 17 has a pair of projections 25 on the opposite lateral edges corresponding to the lateral edges 30 of the recess 16. The glass is thus mounted in a case in the similar manner to the previous embodiment.

In accordance with this embodiment, manufacturing of the case may be easily carried out by cutting in spite of rectangular opening, because the engaging grooves 21 are partially provided. It has been found that deflection "t" is 0.15 mm in the lateral edge and 0.05 mm in the longitudinal edge for perferable watertight and dust proof.

Figure 6:
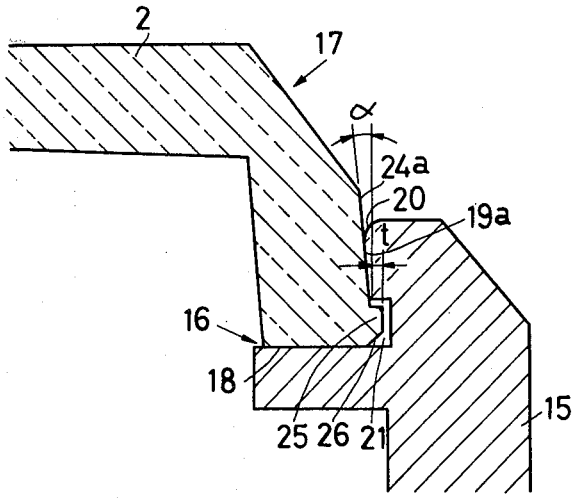
FIG. 6 is a sectional view showing a further embodiment of the present invention.

Referring to FIG. 6, the recess 16 of the case 15 has a reversely beveled or undercut glass fitting portion 19*a*, and the plastic glass 17 has an outward beveled fitting portion 24*a* corresponding to the undercut fitting portion 19*a*. Other portions are similar to the embodiment of FIG. 2 in structure. In accordance with this embodiment, the fitting portion 24*a* of the glass engages with the fitting portion 19*a* of the case in the taper engagement, whereby press fitting between the glass and the case may be ensured. Thus, it is possible to provide a water proof and dust proof glass mounting structure having higher reliability when compared to the conventional glass mounting structure. A preferable angle $\alpha$ of the reverse bevel is about 5°. It will be noted that it is possible to provide a slight difference between the angles of both beveled fitting portions.

Figure 7:
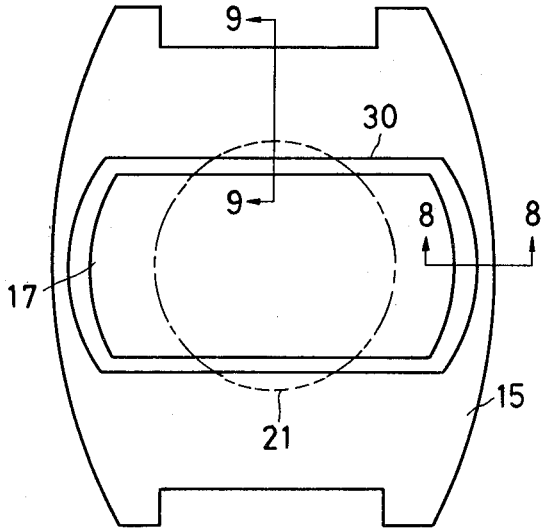
FIG. 7 is a plan view showing a watch case according to still another embodiment of the present invention.
Figure 8:
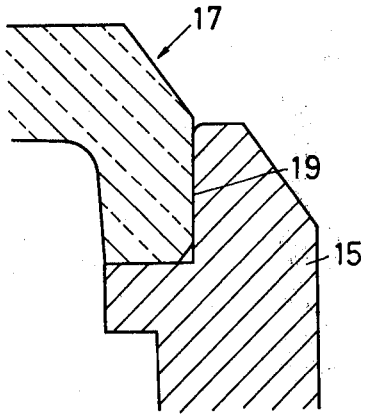
FIG. 8 is a sectional view taken along the line 8—8 in FIG. 7.
Figure 9:
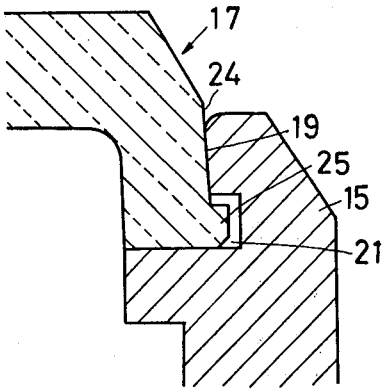
FIG. 9 is a sectional view taken along the line 9—9 in FIG. 7.

The embodiment shown in FIGS. 7 to 9 is similar to that of FIGS. 3 to 5. The fitting portions 19 and 24 adjacent to the groove 21 and projection 25 along the lateral edges 30 are beveled as the previous embodiment. It should be noted that the beveled engagement relation between the glass and the case may be provided around the whole periphery thereof.

Figure 10:
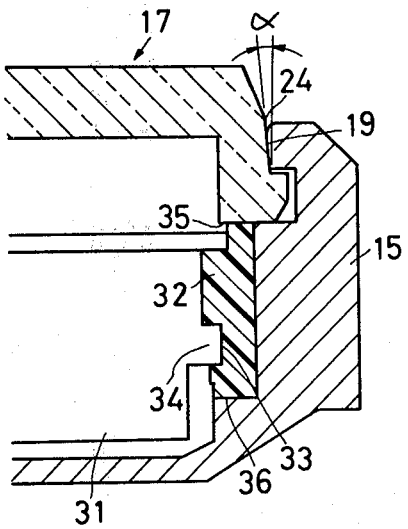
FIG. 10 is a sectional view showing still a further embodiment of the present invention.

Referring to FIG. 10, in this embodiment a movement 31 is mounted in the case 15 by means of a mounting ring 32 formed of plastic. The mounting ring 32 has a groove 33, with which the flange 34 of the movement is engaged. The underside 35 of the axially extending cylindrical portion 23 of the glass abuts against the top of the mounting ring 32. In this mounting structure, the glass urges the mounting ring 32 toward the receiving surface 36 of the case 15, whereby the mounting ring may be firmly supported against movement within the case.

It is apparent from the above discussion that the present invention provides a mounting structure of plastic glass in the watch case in which the plastic glass may be fitted in the watch case without causing excessive deflection and resulting stress in the glass, thereby insuring the water proof and dust proof features of the mounting structure and providing a long life of the glass. The glass may be easily fitted in the case by pushing it into the recess of the watch without requiring any degree of skill.

What is claimed is:

1. A mounting structure for mounting a plastic glass to a watch case comprising:

a recess provided on an upper portion of said watch case for receiving said plastic glass;

said recess comprising an entrance edge, an axially extending glass-fitting portion adjacent said entrance edge, and a radially extending glass-receiving portion;

an engaging groove provided adjacent the extreme end of said glass-fitting portion;

a beveled guiding portion provided in said entrance edge;

said plastic glass comprising a central portion, an axially extending portion, a fitting portion provided on the outer periphery of said axially extending portion, so as to be abutted on the entire surface of said axially extending glass-fitting portion of said recess;

an annular extending projection provided on said outer periphery and adapted to engage with said engaging groove; and a beveled guiding portion provided in the leading edge of said annular extending projection, said beveled guiding portion of said recess and said beveled guiding portion of said glass being so arranged that both guiding portions engage with each other when the glass is put on the watch case, and said glass being adapted to be inserted into said recess with the annular extending projection sliding on the guiding portion and on the axially extending portion of the recess by the force axially applied to the glass and the annular extending projection being adapted to engage said groove at the bottom of the recess, whereby said fitting portion of the glass may be abutted on substantially the entire surface of said axially extending glass-fitting portion.

2. A mounting structure of plastic glass in the watch case according to claim 1 in which said annular extending projection has an axially extending outer periphery which slides on said axially extending glass fitting portion when the plastic glass is inserted into the watch case.

3. A mounting structure of plastic glass in the watch case according to claim 1 in which said glass fitting portion is provided with an inwardly canted surface and the fitting portion of the plastic glass is provided with a complimentary outwardly canted surface.

4. A mounting structure of plastic glass in the watch case according to claim 1 in which said engaging groove is provided along the entire recess and said radially extending projection is provided along the entire periphery of the glass.

5. A mounting structure of plastic glass in the watch case according to claim 1 in which said plastic glass has a non-circular shape and said engaging groove and projection are provided on opposite edges of said recess and glass respectively.

6. A mounting structure of plastic glass in the watch case according to claim 5 in which said engaging groove has a semicircular shape in the plan view thereof.

7. A mounting structure for mounting a plastic glass to a watch case comprising:

a mounting ring for supporting a movement in the watch;

a recess provided on an upper portion of said watch case for receiving said plastic glass;

said recess comprising an entrance edge, an axially extending glass-fitting portion adjacent said entrance edge, and a radially extending glass-receiving portion;

an engaging groove provided adjacent the extreme end of said glass-fitting portion;

a beveled guiding portion provided in said entrance edge;

said plastic glass comprising a central portion, an axially extending portion, a fitting portion provided on the outer periphery of said axially extending portion;

an annular extending projection provided on said outer periphery and adapted to engage with said engaging groove; and a beveled guiding portion provided in the leading edge of said annular extending projection, said beveled guiding portion of said recess and said beveled guiding portion of said glass being so arranged that both guiding portions engage with each other when the glass is put on the watch case, and said glass being adapted to be inserted into said recess with the annular extending projection sliding on the guiding portion and on the axially extending portion of the recess and the annular extending projection being adapted to engage said groove at the bottom of the recess and the underside of said axially extending portion being adapted to abut against the top of said mounting ring.

8. A mounting structure of plastic glass in the watch case according to claim 7 wherein said fitting portion provided on the outer periphery of said axially extending portion is adapted so as to be abutted on substantially the entire surface of said axially extending glass-fitting portion, said glass being adapted to be inserted into said recess by the force axially applied to the glass, and whereby said fitting portion of the glass may be abutted on substantially the entire surface of said axially extending glass-fitting portion.

* * * * *